US006688550B1

(12) United States Patent
Mullins

(10) Patent No.: US 6,688,550 B1
(45) **Date of Patent: *Feb. 10, 2004**

(54) PORTABLE SUPPLY RACK FOR SPOOL-DISPENSED MATERIALS

(76) Inventor: William Presley Mullins, 10409 Reid La., Nokesville, VA (US) 20181

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 518 days.

(21) Appl. No.: 09/160,085

(22) Filed: Sep. 25, 1998

(51) Int. Cl.[7] ..... B65H 16/02

(52) U.S. Cl. ..... 242/594.4; 242/597.8; 242/598.5; 182/129

(58) Field of Search ..... 242/594.4, 594.5, 242/594, 594.6, 597.8, 598, 598.5, 129.5, 129.6, 129.62, 404.3, 132, 137, 137.1, 138, 146; 211/59.1, 85.5; 182/129; 248/339, 340, 341

(56) References Cited

U.S. PATENT DOCUMENTS

| | | | | | |
|---|---|---|---|---|---|
| 343,749 | A | * | 6/1886 | Baker | |
| 399,921 | A | * | 3/1889 | Norton | 242/138 X |
| 444,113 | A | * | 1/1891 | Blackmore | |
| 489,593 | A | * | 1/1893 | Ramer | |
| 1,049,021 | A | * | 12/1912 | Williams | 242/129.62 |
| 1,421,099 | A | * | 6/1922 | Reed | |
| 1,476,778 | A | * | 12/1923 | Tate | |
| 1,714,469 | A | * | 5/1929 | Hoffman | 242/146 X |
| 2,074,411 | A | * | 3/1937 | McDougall | 242/404.3 X |
| 2,147,216 | A | * | 2/1939 | Raasch | 242/129.6 |
| 3,279,720 | A | * | 10/1966 | Garrett | 242/129.6 |
| 3,383,071 | A | * | 5/1968 | Godson | |
| 3,656,699 | A | * | 4/1972 | Schnyder et al. | |
| 3,696,697 | A | * | 10/1972 | Hoffman | |
| 3,771,743 | A | | 11/1973 | DeLuca et al. | |
| 3,979,097 | A | | 9/1976 | Balne | |
| 4,022,394 | A | * | 5/1977 | Gudde | 242/129.6 |
| 4,059,243 | A | * | 11/1977 | Hartley | 242/129.6 |
| 4,074,872 | A | * | 2/1978 | Marshall, Jr. | 242/597.7 |
| 4,120,472 | A | | 10/1978 | Balne | |
| 4,457,527 | A | * | 7/1984 | Lowery | |
| 4,533,091 | A | | 8/1985 | Knight et al. | |
| 4,548,368 | A | | 10/1985 | Tomlison | |
| D293,182 | S | * | 12/1987 | Carter | |
| 4,834,331 | A | * | 5/1989 | Domingo | 242/129.6 X |
| 4,869,344 | A | | 9/1989 | Peterson | |
| 5,285,981 | A | * | 2/1994 | Pavelka | |
| 5,308,012 | A | * | 5/1994 | Fuller | |
| 5,421,428 | A | * | 6/1995 | Ingles | 182/129 X |
| 5,509,671 | A | * | 4/1996 | Campbell | |
| 5,655,622 | A | | 8/1997 | Pavlu | |
| 5,887,819 | A | * | 3/1999 | Korn et al. | |

FOREIGN PATENT DOCUMENTS

| | | | | |
|---|---|---|---|---|
| IT | 248693 | * | 6/1926 | 242/594.5 |
| WO | 4022753 | * | 10/1994 | 242/594.4 |

* cited by examiner

*Primary Examiner*—William A. Rivera

(57) ABSTRACT

A supply rack includes a primary support wall having a front face, a rear face, an upper edge, a lower edge, and opposing vertical side edges. A pair of side walls extend from the primary support wall, each side wall further terminating in an outer vertical edge and having a plurality of apertures formed through the side wall adjacent the outer vertical edge, whereby apertures in one side wall are aligned with corresponding apertures in a remaining side wall. At least one support rod having opposite ends is provided. Each of the opposite ends of the support rod is insertable through corresponding aligned apertures in the pair of side walls, the at least one support rod including holes formed therethrough adjacent opposite ends thereof. A hanger portion of either an arcuate or an angular shape is coextensively formed with the upper edge of the primary support wall, such that the hanger portion solely supports a weight of the supply rack. Alternatively, a single intermediate wall may be used in place of the opposing side walls, the at least one support rod being inserted though just one aperture of the intermediate wall.

34 Claims, 6 Drawing Sheets

PORTABLE SUPPLY RACK FOR SPOOL-DISPENSED MATERIALS

BACKGROUND OF THE INVENTION

1. Field of the Invention

The present invention relates to a portable supply rack for spool-dispensed materials useable in a variety of applications. More specifically, the present invention relates to a portable wire supply rack for hanging on ladder or the like.

2. Description of Related Art

Known wire supply racks include a combined wire spool holding and dispensing apparatus in which a frame for holding the spools of wire are permanently connected with a ladder or other similar structure. In order to permanently have the spools of wire mounted to the ladder, the spools or frames for the spools are fixed to the side rails of the ladder by bolts or the like. The arrangement precludes the easy transportation of the spools and/or frames for the spools of wire to another work station or ladder as may be needed. In addition, the known arrangements are complicated in structure, difficult to use, and are not universally applicable to other industries in which a material is dispensed from a spool.

A problem exists, therefore, in that the known wire supply racks are not easily portable or usable in a variety of applications.

Accordingly, while the conventional wire supply racks and mounting arrangements therefore were suitable for their intended purpose, the need for simplification in mounting and a more universal design necessitated the development of a portable wire supply rack as defined by the present invention.

SUMMARY OF THE INVENTION

It is therefor an object of the present invention to provide wire supply rack which overcomes the problems of the art identified above.

More particularly, it is an object of the invention to provide a wire supply rack which is easily portable between work locations.

Still further, it is an object of the invention to provide a wire supply rack which need not be fixed to the work station at which it is being used.

Even further, it is an object of the invention to provide a wire supply rack which is stabilized simply by hanging it at a desired work station.

Additionally, it is an object of the invention to provide a wire supply rack which permits easy interchanging of wire spools thereon.

In achieving the objects of the present invention, there is provided a supply rack for spool-dispensed materials including a primary support wall having a front face, a rear face, an upper edge, a lower edge, and opposing vertical side edges. A pair of side walls extend from the primary support wall, each side wall further terminating in an outer vertical edge and having a plurality of apertures formed through the side wall adjacent the outer vertical edge, whereby apertures in one side wall are aligned with corresponding apertures in a remaining side wall. At least one support rod having opposite ends is provided. Each of the opposite ends of the support rod is insertable through corresponding aligned apertures in the pair of side walls, the at least one support rod including holes formed therethrough adjacent opposite ends thereof. A hanger portion of either an arcuate or an angular shape is coextensively formed with the upper edge of the primary support wall, such that the hanger portion solely supports a weight of the supply rack. Alternatively, a single intermediate wall may be used in place of the opposing side walls, the at least one support rod being inserted though just one aperture of the intermediate wall.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
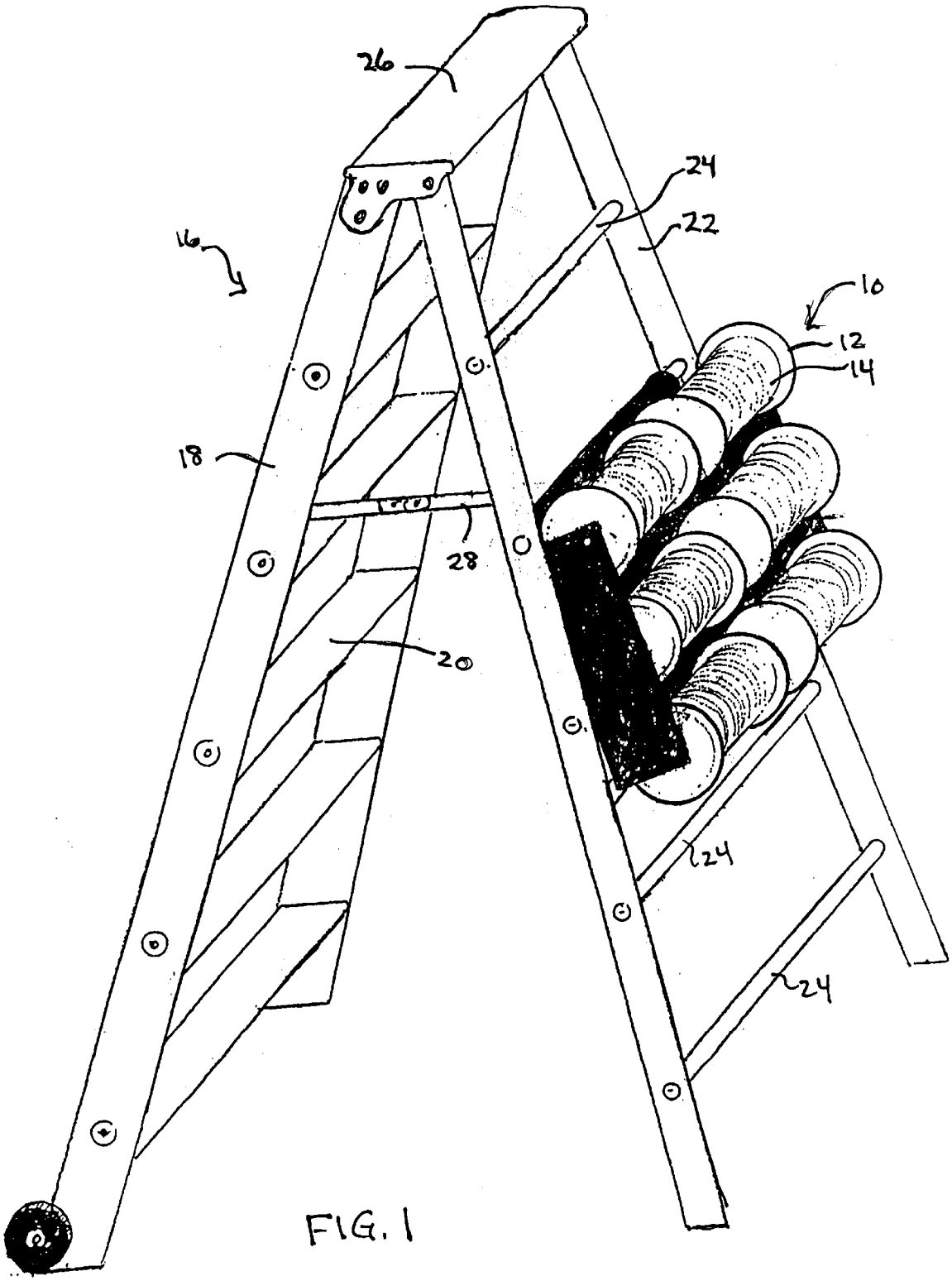
FIG. 1 is a perspective view of a supply rack mounted on a ladder according to a first preferred embodiment of the present invention.

Referring first to FIG. 1, there is shown a perspective view of a supply rack 10 having spools 12 of material thereon and mounted on a ladder 14 according to a first preferred embodiment of the present invention.

In general, the spool 12 is intended to illustrate any spool known in the art of the type having a longitudinal opening (not shown) therethrough and a material 14 wound around an outer surface of the spool 12. In addition, the ladder 16 is intended to illustrate a known ladder and does not form any part of the invention. Instead, reference to the ladder 16 is for the purposes of explanation of the invention and generally includes front side rails 18 having a plurality of evenly spaced steps 20 therebetween, rear side rails 22 having a plurality of rungs 24 evenly spaced therebetween, a top step 26 joining the front side rails 18 to the rear side rails 22 and defining a pivot point for the front and tear side rails at a vertex of the ladder 16, and pivotal locking braces 28 joining the front side rails 18 to the rear side rails 22 at a location substantially intermediate a length of the rails.

The supply rack 10 is shown mounted on the ladder 16 in FIG. 1 to illustrate an intended use of the supply rack 10. In addition, the supply rack is shown with the spools 12 mounted thereon as is the case when the supply rack 10 is in use.

Referring more specifically to the features of the supply rack 10, the supply rack 10 includes a primary support wall 30 having a front surface 32, a rear surface 34, opposing vertical edges 36, and an upper end 38 and a lower end 40 oriented transverse to the opposing vertical edges 36. Side walls 42 are formed to extend from the opposing vertical edges 36 of the supply rack 10 so as to project substantially perpendicular to the front face 32 of the rack. Each of the side walls 42 include spaced apertures 44 formed therein and aligned so as to correspond to spaced apertures 44 on an opposing side wall 42. The number of apertures 44 is determined by the number of material spools 12 to be supported by the supply rack 10.

Figure 2:
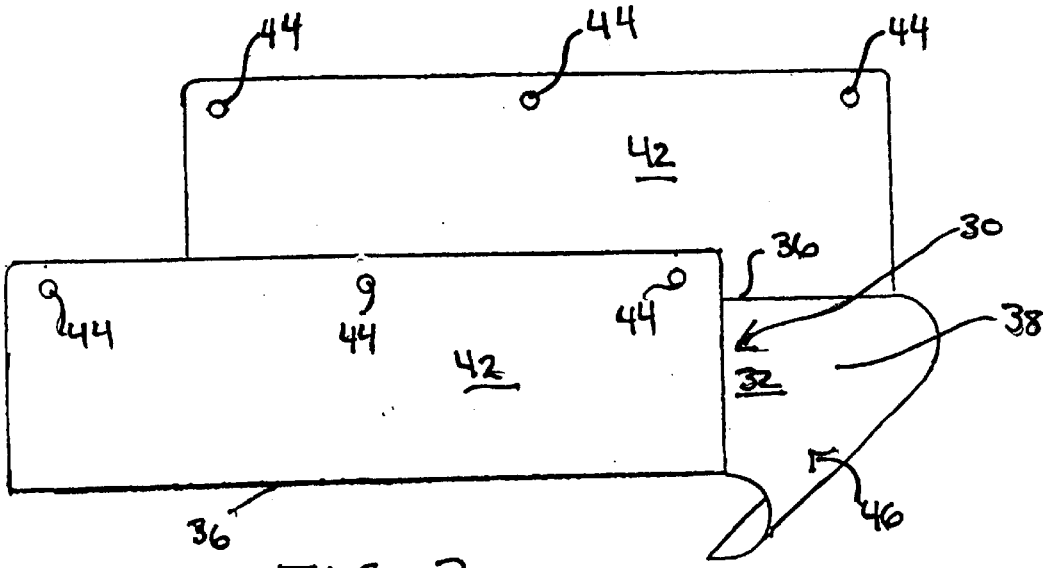
FIG. 2 is a side perspective view of a body of the supply rack according to FIG. 1 shown alone.

As shown best in FIG. 2, the side walls 42 are preferably positioned at the outermost vertical edges 36 of the primary support wall 30, but may be set in from the edges 36 of the primary support wall 30 should the environment or materials for the supply rack 10 require such a construction. The distance of projection of the side walls 42 from the primary support wall 30 is of a distance to accommodate the spool 12 of material therein and permit free rotation of the spool 12 without contacting either the primary support wall 30 or the side walls 42 of the supply rack 10. In addition, the side walls 42 extend from the upper end 38 to the lower end 40 of the primary support wall 30. An important result of the side walls 42 corresponding to a length of the primary support wall 30 is that the side walls 42 assist to stabilize the primary support wall 30 and prevent any twist or torque of the primary support wall 30 when the weight of the spools 12 is loaded on the supply rack 10.

Additionally, although the shape of the primary support wall 30 and the side walls 42 are shown to be rectangular, any suitable shape is contemplated to be within the scope of the invention, and any proposed alternative shapes are intended to be included within the scope of the invention.

Figure 3:
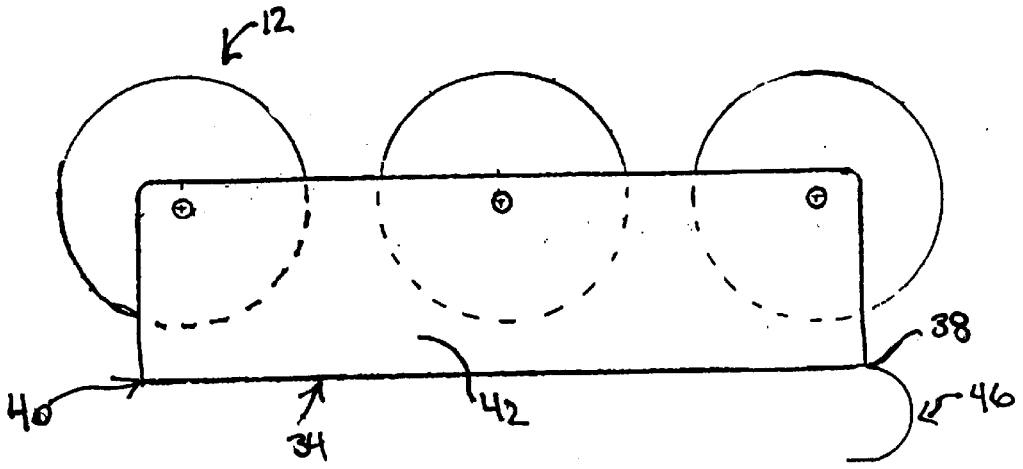
FIG. 3 is a side view of the supply rack according to FIG. 1 including the body, spool rods, and spools.

A further feature of the present invention is a rung gripping portion 46 formed at the upper end 38 of the primary support wall 30. The gripping portion 46 in this embodiment is an arcuately shaped member designed to conform to the rungs 24 of a conventional ladder 16, of the type previously described by way of example. The arcuately shaped rung gripping portion 46 is formed across an entirety of the upper end 38 of the primary support wall 30 to provide maximum stabilization to the supply rack 10 when the supply rack is hung on the rung 24 of the ladder 16. The rung gripping portion 46 is shown to be formed as a one-piece construction with the primary support wall 30 of the supply rack 10. However, the rung gripping portion 46 may also be separately formed and then attached to the upper end 38 of the primary support wall 30. As also best illustrated in FIGS. 2 and 3, the arcuate formation of the rung gripping portion 46 is about 1½ inch in diameter across the arc. This dimension is intended to accommodate most conventional ladder rungs 24, thereby increasing the universal application of the supply rack 10 of the invention.

Figure 4:
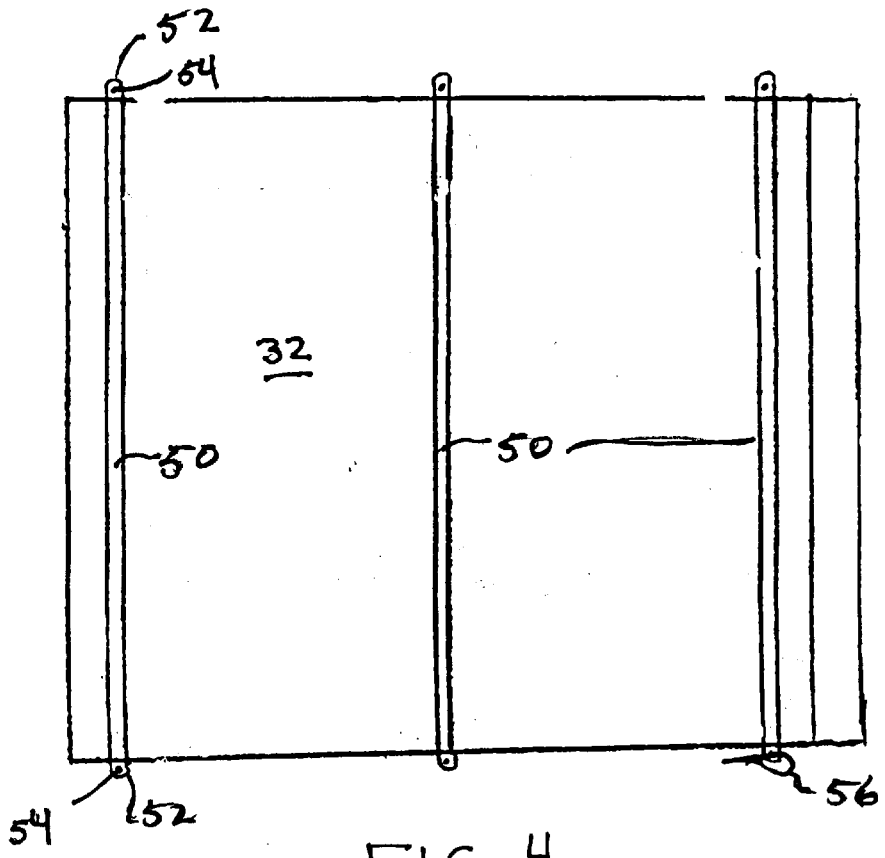
FIG. 4 is a top plan view of the supply rack according to FIG. 1 including spool rods.

Referring now to FIG. 4, a single spool support rod 50 is shown positioned between opposing aligned apertures 44 formed in the side walls 42 of the supply rack 10. The spool support rods 50 are of a diameter to receive a conventional spool 12 thereon and of a length to span at least a width of the primary support wall 30. Each spool support rod 50 has opposing ends 52 by nature of the rod, and each opposing end 52 includes an aperture 54 in the opposing ends 52 thereof. The aperture 54 receives a securing member 56 such as a clip or a pin therein. When the securing member 56 is inserted into the aperture 54 at an end 52 of the spool support rod 50, the spool 12 is secured on the spool support rod 50 and will not slide off even during transport of the supply rack 10.

The spool support rods 50 are spaced apart to allow a desired size of spool 12 to be slid thereon and there is no requirement that all spool support rods 50 be loaded in order to use the supply rack 10. Additionally, the number and positioning of the spool support rods 50 is according to a user's preferences. For example, it is not necessary that the spool support rods 50 be evenly spaced, and may instead be unevenly spaced to accommodate different sizes of spools 12.

The spool support rods 50 are, for example, made of ½ inch steel with a ⅛ inch drilled hole 54 at the opposite ends 52 thereof. The only requirement is that the drilled holes 54 of the spool support rods 50 are in a portion of the spool support rod 50 that extends beyond the side walls 42 of the supply rack 10. Although the spool supply rods 50 are described as being formed of steel, any suitable material may be used so long as the material is capable of supporting the weight of the particular spool of material being used. For example, the spool support rod 50 may alternatively be formed of graphite, high strength plastic, wood, and so on.

Figure 5:
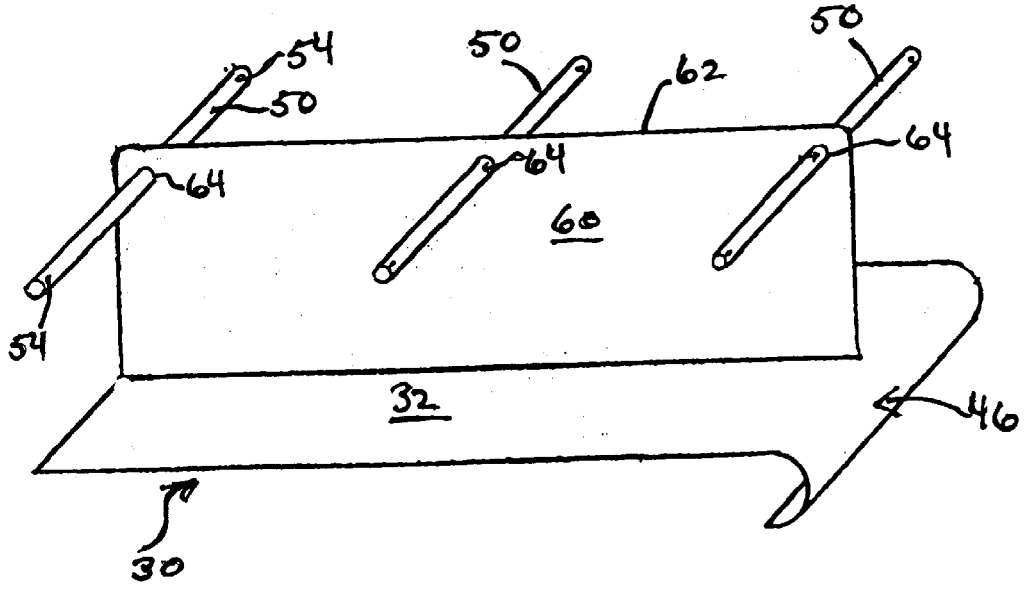
FIG. 5 is a side perspective view of a supply rack illustrating a modification to the first embodiment shown in FIG. 1.

Turning now to FIG. 5, there is illustrated an alternative to the first preferred embodiment of FIG. 1. In particular, FIG. 5 demonstrates the use of a single intermediate wall member 60. The intermediate wall member 60 is stamped, extruded, or fixed to the primary support wall 30 so as to extend perpendicularly therefrom and from the upper end 38 to the lower end 40 of the primary support wall 30. As shown, the intermediate wall member 60 is substantially intermediate the opposite vertical edges 36 of the primary support wall 30, but may be at any suitable interior surface location thereon. The intermediate support wall 60 includes an exposed vertical edge 62 not connected to the primary support wall 50 and a plurality of evenly spaced apertures 64 formed through the intermediate support wall and adjacent the exposed vertical edge 62 thereof. As in the embodiment of FIG. 1, the apertures 64 receive the spool support rod 50 therethrough. Opposite ends 52 of the spool support rods 50 continue to include the aperture 54 therein for receiving the securing member 56 such as a clip, pin or the like, the purpose of the securing member 56 in this instance being to secure the material spool 12 on the spool support rod 50.

In use, the spools 12 loaded onto the spool support rod 50 in FIG. 5 are loaded evenly so that a weight of a spool 12 on either side of the intermediate support wall 60 is fairly well balanced. Due to the structure, however, of the intermediate support wall 60 and the primary support wall 30, a substantial uneven load could be applied without twisting or torque of the primary support wall 30.

Figure 6:
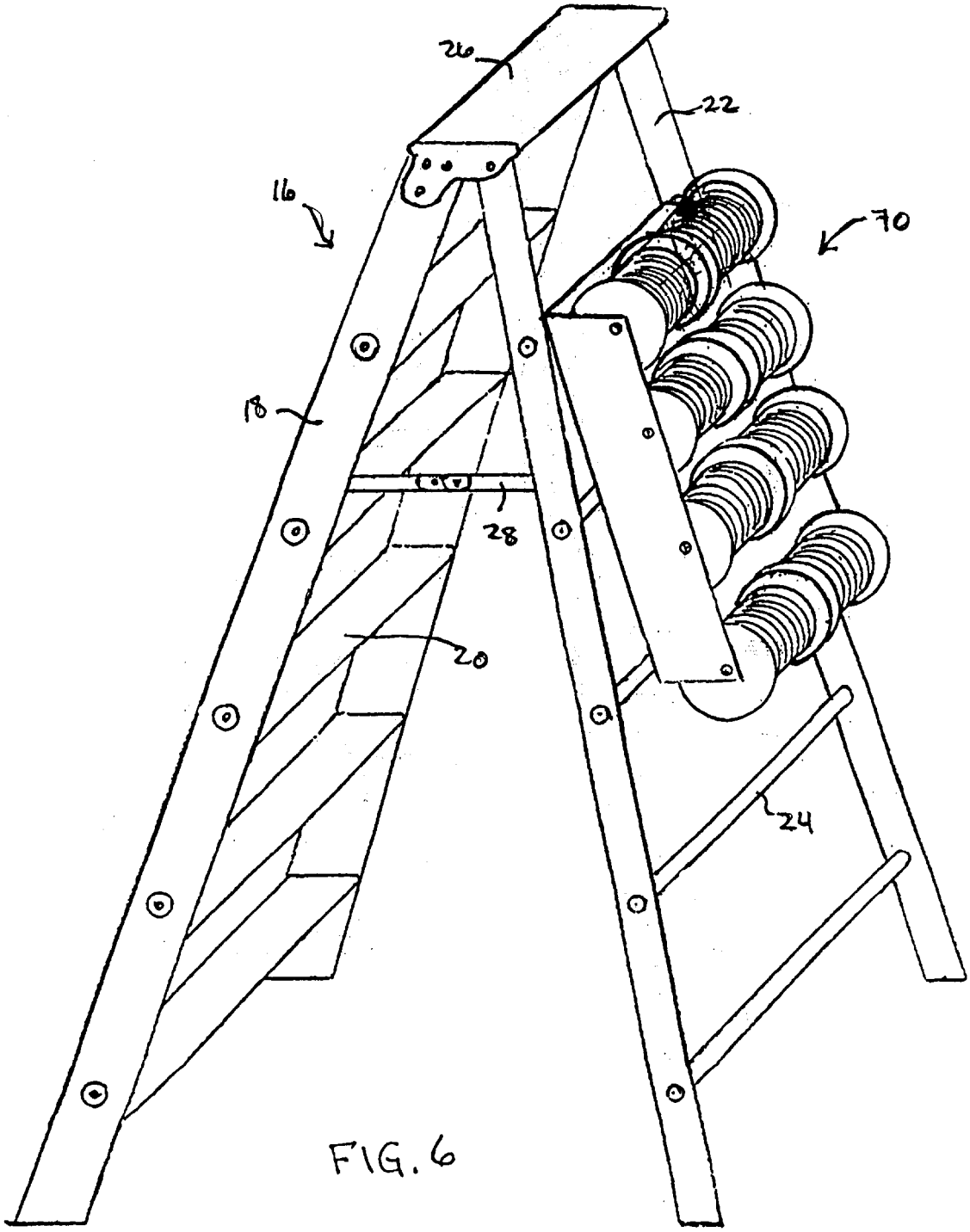
FIG. 6 is a perspective view of a supply rack mounted on a ladder according to a second preferred embodiment of the present invention.

Turning now to FIG. 6, there is illustrated a perspective view of a supply rack 70 having spools 12 of material thereon and mounted on a ladder 14 according to a second preferred embodiment of the present invention.

Once again, the spool 12 is intended to illustrate any spool known in the art of the type as previously described. All elements of the prior figures refer to like elements in the following figures. In addition, the ladder 16 is intended to illustrate a known ladder of the type described above, and like reference numerals are intended to correspond to like parts in the following.

The supply rack 70 is shown mounted on the rungs 24 of the ladder 16 in FIG. 6 to illustrate an intended use of the supply rack 10. However, the supply rack 70 of FIG. 6 may alternatively be hung on a step 20 of the ladder 16 for reasons which will be set forth in the following detailed description.

Referring more specifically to the features of the supply rack 70, the supply rack 70 includes a primary support wall 72 having a front surface 74, a rear surface 76, opposing vertical edges 78, and an upper end 80 and a lower end 82 oriented transverse to the opposing vertical edges 78. Side walls 84 are formed to extend from the opposing vertical edges 78 of the supply rack 70 so as to project substantially perpendicular to the front face 74 of the rack 70. Each of the side walls 84 include spaced apertures 86 formed therein and aligned so as to correspond to spaced apertures 86 on an opposing side wall 84. The number of apertures 86 is determined by the number of material spools 12 to be supported by the supply rack 70.

Figure 7:
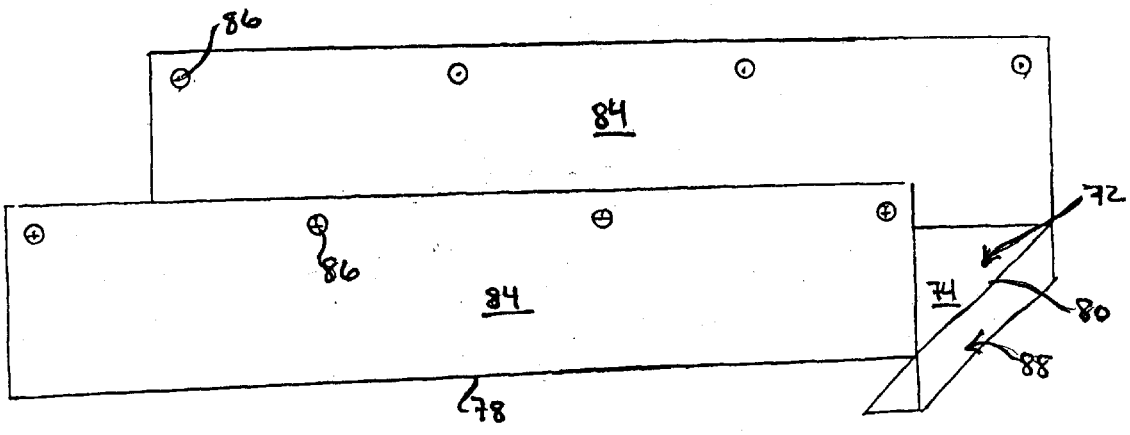
FIG. 7 is:a side perspective view of a body of the supply rack according to FIG. 6 shown alone.

As shown best in FIG. 7, the side walls 84 are preferably positioned at the outermost vertical edges 78 of the primary support wall 72, but may be set in from the edges 78 of the primary support wall 72 should the environment or materials for the supply rack 70 require such a construction. The distance of projection of the side walls 84 from the primary support wall 72 is of a distance to accommodate the spool 12 of material therein and permit free rotation of the spool 12 without contacting either the primary support wall 72 or the side walls 84 of the supply rack 70. In addition, the side walls 84 extend from the upper end 80 to the lower end 82 of the primary support wall 72. An important result of the side walls 84 corresponding to a length of the primary support wall 72 is that the side walls 84 assist to stabilize the primary support wall 72 and prevent any twist or torque of the primary support wall 72 when the weight of the spools 12 is loaded on the supply rack 70.

Additionally, although the shape of the primary support wall 72 and the side walls 84 are shown to be rectangular, any suitable shape is contemplated to be within the scope of the invention, and any proposed alternative shapes are intended to be included within the scope of the invention.

A further feature of the present invention is a rung/step gripping portion 88 formed at the upper end 80 of the primary support wall 72. The gripping portion 88 in this embodiment is an angularly shaped member designed to conform to either the steps 20 or rungs 24 of a conventional ladder 16, of the type previously described by way of example. The arcuately shaped gripping portion 88 is formed across an entirety of the upper end 80 of the primary support wall 72 to provide maximum stabilization to the supply rack 70 when the supply rack is hung on the step 20 or rung 24 of the ladder 16. The gripping portion 88 is shown to be formed as a one-piece construction with the primary support wall 72 of the supply rack 70. However, the gripping portion 88 may also be separately formed and then attached to the upper end 80 of the primary support wall 72. As also best illustrated in FIGS. 7 and 9, the angular formation of the gripping portion 88 is about 1½ inch in diameter. This dimension is intended to accommodate most conventional ladder rungs 24, thereby increasing the universal application of the supply rack 70 of the invention. As suggested, the gripping portion 88 of this embodiment may be enlarged to a size necessary to grip onto a step 20 of a ladder 16 or other similarly shaped structure, thereby further enhancing an ultimate use thereof.

Figure 8:
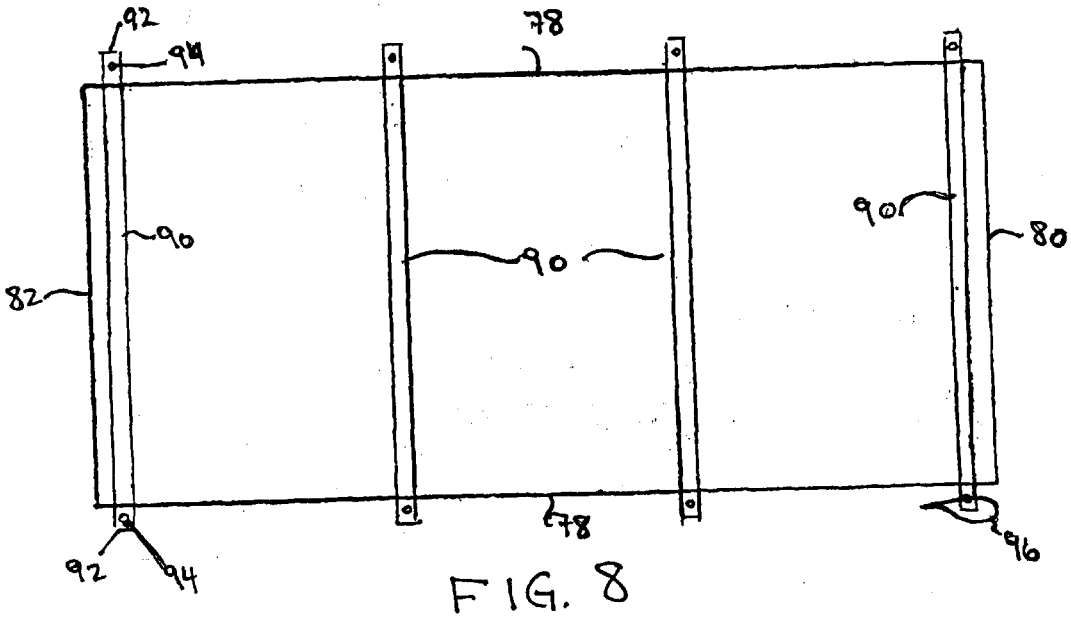
FIG. 8 is a top plan view of the supply rack according to FIG. 6 including spool rods.

Referring now to FIG. 8, a single spool support rod 90 is shown positioned between opposing aligned apertures 86 formed in the side walls 84 of the supply rack 70. The spool support rods 90 are of a diameter to receive a conventional spool 12 thereon and of a length to span at least a width of the primary support wall 72. Each spool support rod 90 has opposing ends 92 by nature of the rod, and each opposing end 92 includes an aperture 94 in the opposing ends 92 thereof. The aperture 94 receives a securing member 96 such as a clip or a pin therein. When the securing member 96 is inserted into the aperture 94 at an end 92 of the spool support rod 90, the spool 12 is secured on the spool support rod 90 and will not slide off even during transport of the supply rack 70.

The spool support rods 90 are spaced apart to allow a desired size of spool 12 to be slid thereon and there is no requirement that all spool support rods 90 be loaded in order to use the supply rack 70. Additionally, the number and positioning of the spool support rods 90 is according to a user's preferences. For example, it is not necessary that the spool support rods 90 be evenly spaced, and may instead be unevenly spaced to accommodate different sizes of spools 12.

The spool support rods 90 are, for example, made of ½ inch steel with a ⅛ inch drilled hole 94 at the opposite ends 92 thereof. The only requirement is that the drilled holes 94 of the spool support rods 90 are in a portion of the spool support rod 90 that extends beyond the side walls 84 of the supply rack 70. Although the spool supply rods 90 are described as being formed of steel, any suitable material may be used so long as the material is capable of supporting the weight of the particular spool of material being used. For example, the spool support rod 90 may alternatively be formed of graphite, high strength plastic, wood, and so on.

Figure 9:
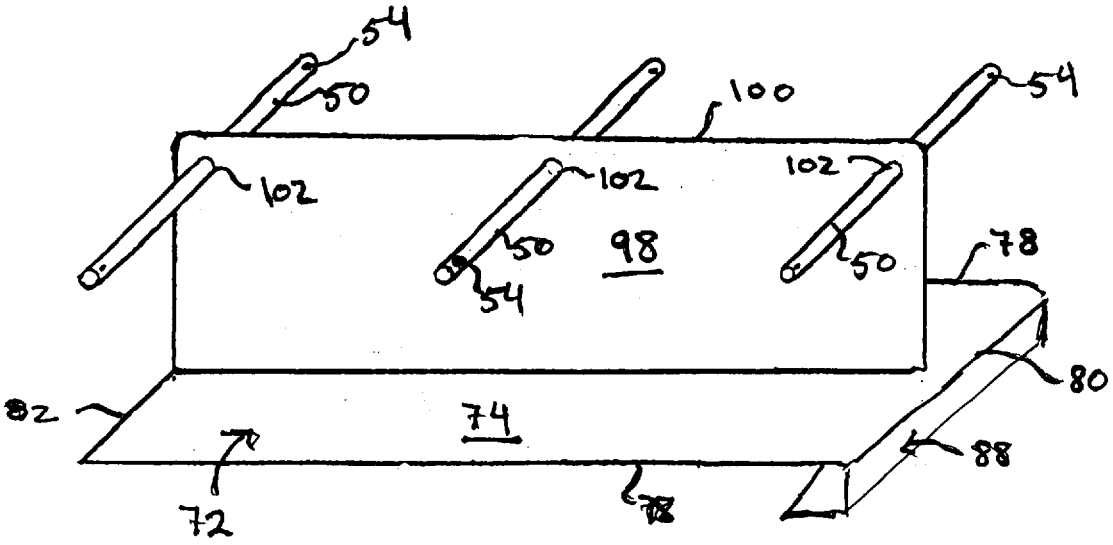
FIG. 9 is a side perspective view of a supply rack illustrating a modification to the second embodiment shown in FIG. 6.

Turning now to FIG. 9, there is illustrated an alternative to the second preferred embodiment of FIG. 6. In particular, FIG. 9 demonstrates the use of a single intermediate wall member 98. The intermediate wall member 98 is stamped, extruded, or fixed to the primary support wall 72 so as to extend perpendicularly therefrom and from the upper end 80 to the lower end 82 of the primary support wall 72. As shown, the intermediate wall member 98 is substantially intermediate the opposite vertical edges 78 of the primary support wall 72, but may be at any suitable interior surface location thereon. The intermediate support wall 98 includes an exposed vertical edge 100 not connected to the primary support wall 72 and a plurality of evenly spaced apertures 102 formed through the intermediate support wall and adjacent the exposed vertical edge 100 thereof. As in the embodiment of FIG. 6, the apertures 102 receive the spool support rod 90 therethrough. Opposite ends 92 of the spool support rods 90 continue to include the aperture 94 therein for receiving the securing member 96 such as a clip, pin or the like, the purpose of the securing member 96 in this instance being to secure the material spool 12 on the spool support rod 90.

In use, the spools 12 loaded onto the spool support rod 90 in FIG. 9 are loaded evenly so that a weight of a spool 12 on either side of the intermediate support wall 98 is fairly well balanced. Due to the structure, however, of the intermediate support wall 98 and the primary support wall 72, a substantial uneven load could be applied without twisting or torque of the primary support wall 72.

Finally, although not illustrated, it is contemplated that the number of intermediate walls may be provided to accommodate virtually any industry and may include more than one intermediate wall between opposite side walls (modifying the subject matter shown in FIGS. 1–8), or may include more than one intermediate wall with no opposing side walls (modifying the subject matter shown in FIG. 9).

In any of the embodiments shown and described, the function is the same. Because of the ability to simply "hook" the supply rack 10, 70 on a ladder rung 24 or a ladder step 20 without additional securing methods, the supply rack is portable, convenient, and applicable to many industries other than wire supply spools for electricians. Racks may easily be made larger or smaller depending upon the ultimate application thereof because there are no intricate connections or the like which would require continual retooling of the forming machine for the supply rack. Additionally, many types of material are available for construction of the supply rack, including plastics, metal, and wood. It is suggested that the supply rack 10, 70 be formed of metal, however, any suitable material is contemplated to be included within the scope of the invention, keeping in mind that a goal of the invention is simplicity of construction and ease of use of the supply rack 10, 70.

By the assembly shown and described, the present invention achieves a unique supply rack for spool-dispensed materials which is universally applicable in the industry.

Such a supply rack for spool-dispensed materials has not previously been known in the art.

The invention being thus described, it will be obvious that the same may be varied in many ways. Such variations are not to be regarded as a departure from the spirit and scope of the invention, and all such modifications as would be apparent to one skilled in the art are intended to be included within the scope of the following claims.

I claim:

1. A freely hanging and independently portable supply rack comprising:

a primary support wall having a front face, a rear face, an upper edge, a lower edge, and opposing parallel side edges;

a pair of parallel side walls, each side wall extending from said primary support wall, each side wall further terminating in an outer edge and having a plurality of apertures formed through the side wall adjacent the outer edge, whereby apertures in one side wall are aligned with corresponding apertures in a remaining side wall;

at least one support rod having opposite ends, each of the opposite ends being insertable through corresponding aligned apertures in said pair of parallel side walls, said at least one support rod including holes formed therethrough adjacent opposite ends thereof; and a hanger portion of equal width to and coextensively formed with the upper edge of said primary support wall, said hanger portion is an arcuately formed extension of said primary support wall, curving toward the rear surface of said primary support wall and solely supporting a weight of said supply rack.

2. The supply rack according to claim 1, wherein said side walls extend from the upper edge to the lower end of said primary support wall.

3. The supply rack according to claim 1, wherein said side walls are formed at opposing vertical side edges of said primary support wall.

4. The supply rack according to claim 1, wherein said side walls are set in from opposing vertical side edges of said primary support wall.

5. The supply rack according to claim 1, wherein said side walls are integrally formed with said primary support wall.

6. The supply rack according to claim 1, wherein said side walls are formed as a one-piece construction with said primary support wall.

7. The supply rack according to claim 1, wherein said hanger portion is coextensive with a width of said primary support wall.

8. The supply rack according to claim 7, wherein said hanger portion is integrally formed with said primary support wall.

9. The supply rack according to claim 8, wherein said hanger portion is formed as a one-piece construction with said primary support wall.

10. The supply rack according to claim 1, wherein said at least one support rod includes three support rods.

11. The supply rack according to claim 1, wherein said at least one support rod includes four support rods.

12. A hanging supply rack comprising:

a primary support wall having a front face, a rear face, an upper edge, a lower edge, and opposing vertical side edges;

an intermediate wall, said intermediate wall extending from said primary support wall and terminating in an outer vertical edge and having a plurality of apertures formed therethrough and adjacent the outer vertical edge;

at least one support rod having opposite ends, said at least one support rod being insertable through one of said plurality of apertures in said intermediate wall, and said at least one support rod including holes formed therethrough adjacent opposite ends thereof; and a hanger portion coextensively formed with the upper edge of said primary support wall, said hanger portion solely supporting a weight of said supply rack.

13. The supply rack according to claim 12, wherein said intermediate wall extends from the upper end to the lower end of said primary support wall.

14. The supply rack according to claim 12, wherein said intermediate wall is formed substantially mid-way between opposing vertical side edges of said primary support wall.

15. The supply rack according to claim 12, wherein said intermediate wall is off-set from one of the opposing vertical side edges of said primary support wall.

16. The supply rack according to claim 12, wherein said intermediate support wall is integrally formed with said primary support wall.

17. The supply rack according to claim 16, wherein said intermediate support wall is formed as a one-piece construction with said primary support wall.

18. The supply rack according to claim 12, wherein said hanger portion is an arcuately formed extension of said primary support wall, curving toward the rear surface of said primary support wall.

19. The supply rack according to claim 12, wherein said hanger portion is an angularly formed extension of said primary support wall, and includes right angles so as to terminate toward the rear surface of said primary support wall.

20. The supply rack according to claim 12, wherein said hanger portion is coextensive with a width of said primary support wall.

21. The supply rack according to claim 20, wherein said hanger portion is integrally formed with said primary support wall.

22. The supply rack according to claim 21, wherein said hanger portion is formed as a one-piece construction with said primary support wall.

23. The supply rack according to claim 12, wherein said at least one support rod includes three support rods.

24. The supply rack according to claim 12, wherein said at least one support rod includes four support rods.

25. A freely hanging and independently portable supply rack comprising:

a primary support wall having a front face, a rear face, an upper edge, a lower edge, and opposing parallel side edges;

a pair of parallel side walls, each side wall extending from said primary support wall, each side wall further terminating in an outer edge and having a plurality of apertures formed through the side wall adjacent the outer edge, whereby apertures in one side wall are aligned with corresponding apertures in a remaining aide wall;

at least one support rod having opposite ends, each of the opposite ends being insertable through corresponding aligned apertures in said pair of parallel side walls, said at least one support rod including holes formed therethrough adjacent opposite ends thereof; and a hanger portion of equal width to and coextensively formed with the upper edge of said primary support wall, said hanger portion is an angularly formed extension of said primary support wall, including right angles so as to terminate toward the rear surface of said primary support wall and solely support a weight of said supply rack.

26. The supply rack according to claim 25, wherein said side walls extend from the upper edge to the lower edge of said primary support wall.

27. The supply rack according to claim 25, wherein said side walls are formed at opposing vertical side edges of said primary support wall.

28. The supply rack according to claim 25, wherein said aide walls are set in from opposing vertical side edges of said primary support wall.

29. The supply rack according to claim 25, wherein said side walls are integrally formed with said primary support wall.

30. The supply rack according to claim 25, wherein said side walls are formed as a one-piece construction with said primary support wall.

31. The supply rack according to claim 25, wherein said hanger portion is coextensive with a width of said primary support wall.

32. The supply rack according to claim 25, wherein said hanger portion is integrally formed with said primary support wall.

33. The supply rack according to claim 32, wherein said hanger portion is formed as a one-piece construction with said primary support wall.

34. The supply rack according to claim 25, wherein said at least one support rod includes three support rods.

* * * * *